United States Patent [19]

Studebaker

[11] Patent Number: 4,623,113

[45] Date of Patent: Nov. 18, 1986

[54] PLANT CONTAINER WALL SUPPORT

[76] Inventor: Kendall D. Studebaker, 8091 Woodglen Cir., La Palma, Calif. 90623

[21] Appl. No.: 708,977

[22] Filed: Mar. 7, 1985

[51] Int. Cl.[4] ..... A47K 1/08

[52] U.S. Cl. ..... 248/311.2; 47/67; 47/39; 248/312.1; 248/313; 248/558

[58] Field of Search ..... 248/311.2, 312.1, 313, 248/310, 309.1, 558, DIG. 7; 211/88, 71; 47/39, 67; D11/164

[56] References Cited

U.S. PATENT DOCUMENTS

| | | | |
|---|---|---|---|
| 2,266,294 | 12/1941 | Allderdice | 248/311.2 |
| 2,636,299 | 4/1953 | McDermott | 248/313 X |
| 3,193,234 | 7/1965 | Thurman et al. | 248/313 |
| 4,071,976 | 2/1978 | Chernewski | 248/312.1 X |
| 4,133,509 | 1/1979 | Kalbow et al. | 248/313 |
| 4,422,610 | 12/1983 | Hunt | 248/311.2 |
| 4,452,415 | 6/1984 | Arnold | 248/312.1 |

*Primary Examiner*—Ramon O. Ramirez

*Attorney, Agent, or Firm*—Christie, Parker & Hale

[57] ABSTRACT

A detachable, adjustable plant container support for supporting a plant container alone or with a planting medium and plants on a vertical surface such as a wall, a post or tree. The plant container support comprises a wall bracket which can be permanently secured to a vertical surface and a plant container holder which is detachably supported on the wall bracket. The plant container is adjustable to support plant containers of various widths and heights. The plant container holder has a upper bracket for supporting the upper lip or edge of the container and a base member for supporting the base or bottom of a plant container.

7 Claims, 4 Drawing Figures

12
26
20
22
25
82
86
80
88
84
14
30
36
34
50
38
40
48
46
44
56
54
32
60
62
58
74
72
70
68
18
20
24
16

PLANT CONTAINER WALL SUPPORT

TECHNICAL FIELD

This invention relates to a plant container wall support that is easily detachable from its wall mounted support bracket. The plant container wall support is adjustable and can accommodate open-top plant containers of varying width and height.

BACKGROUND OF THE INVENTION

Plants have been grown in containers for at least 500 years. In more recent time, potted plants have been used as a decorative motif both indoors and outdoors. Although the majority of potted plants are supported on the floor or ground, numerous means and devices have been used or developed to support potted plants above the floor or ground, such as, for example, wall niches, window ledges, book shelves, stands for potted plants, and wall or ceiling mounted slings of rope, cable, wire, chain and the like. These means take up otherwise usable space, are expensive, are difficult to make (such as adding a wall niche to an existing wall), are not adaptable to different size containers and/or do not provide easy access to the plant.

To circumvent many of the above problems, a number of devices have been developed for supporting potted plants on the wall. U.S. Pat. Nos. 2,967,691; 3,001,753; 3,091,424; 3,193,234 and U.S. Pat. No. 191,874 disclose devices for detachably securing a pot having a horizontal, circumferentially extending shoulder, such as the ubiquitous orange colored clay pot. These are useful devices, but there use is limited to small pots since such pots are not designed or constructed to bear the entire weight of the pot and its concents on a small portion of the pot's shoulder and upper rim.

U.S. Pat. Nos. 1,930,673; 2,266,294; 2,732,954; 4,071,976; 4,422,610 and U.S. Pat. No. 90,966 are directed to plant container supports having means for supporting a container on its base and securing its top in order to prevent the pot from rolling or sliding off the base support. Although these flower pot holders can be constructed to support large plant pots, they do not provide a means of readily removing the pot from the wall in order to maintain the plant in the pot.

SUMMARY OF THE INVENTION

The invention resides in a novel and efficient planter container support adapted to be mounted on a vertical surface, such as a wall, vertical post, tree and the like. The support is practically invisible when mounted on a vertical member, the greater part of the support being hidden by the container and the planter plants contained therein. The support does not detract from the beauty of the container and the plant. The support supports or holds the container and plant in a vertical position in a spaced relation to the vertical surface in a safe and stable condition. The maintenance of the container and plant in a vertical position is essential to insure uniform watering and nutrition of the plant, uniform growth of the plant root system and uniform growth of the plant itself.

The detachable, adjustable plant container support device comprises a wall bracket and plant container holder. The container's support member is easily and readily attached to and supported on the wall bracket. In addition, the container support member is easily and readily detachable from the wall bracket in order to remove the container and plant for maintenance and the like. The container support member is a practical supporting fixture for the container and securely supports and holds the container with its plant. In addition, the container support member is adjustable for supporting containers of varying sizes and diameters. Additionally, the support provides a holder device which permits the presentation or display of containerized plants and flowers in a manner which does not detract from the attractiveness of the plants and flowers in the supported container.

The detachable, adjustable plant container support device of the present invention comprises a wall bracket and the plant container support, said wall bracket comprising a U-shaped longitudinal member having first and second upwardly extending parallel arms in a spaced apart relationship, the first arm adapted to be secured to a vertical surface and the second arm having two upwardly extending parallel tines separted by an open slot adapted to detachably receive a hanger means, said plant container support comprising a clamping member and a base member and retaining means for securing said clamping member to said base member, and means for detachably securing said plant container support to said wall bracket, said clamping member adapted to hook over the top edge of an open top plant container to secure said container from pitching and rolling with respect to said base member, said base member adapted to receive and support the base of the plant container, said retaining means for retaining said clamping member and said base member attached to the hanger means for detachably securing said plant container support to said wall bracket.

The clamping member and base member of the plant container support are adapted to be vertically extended towards or away from each other so that the plant container support can be adjusted to support plant containers of different heights.

Other features and advantages of the invention will become more readiy apparent from the following description and the accompanying drawings.

DETAILED DESCRIPTION OF THE INVENTION

Figure 1:
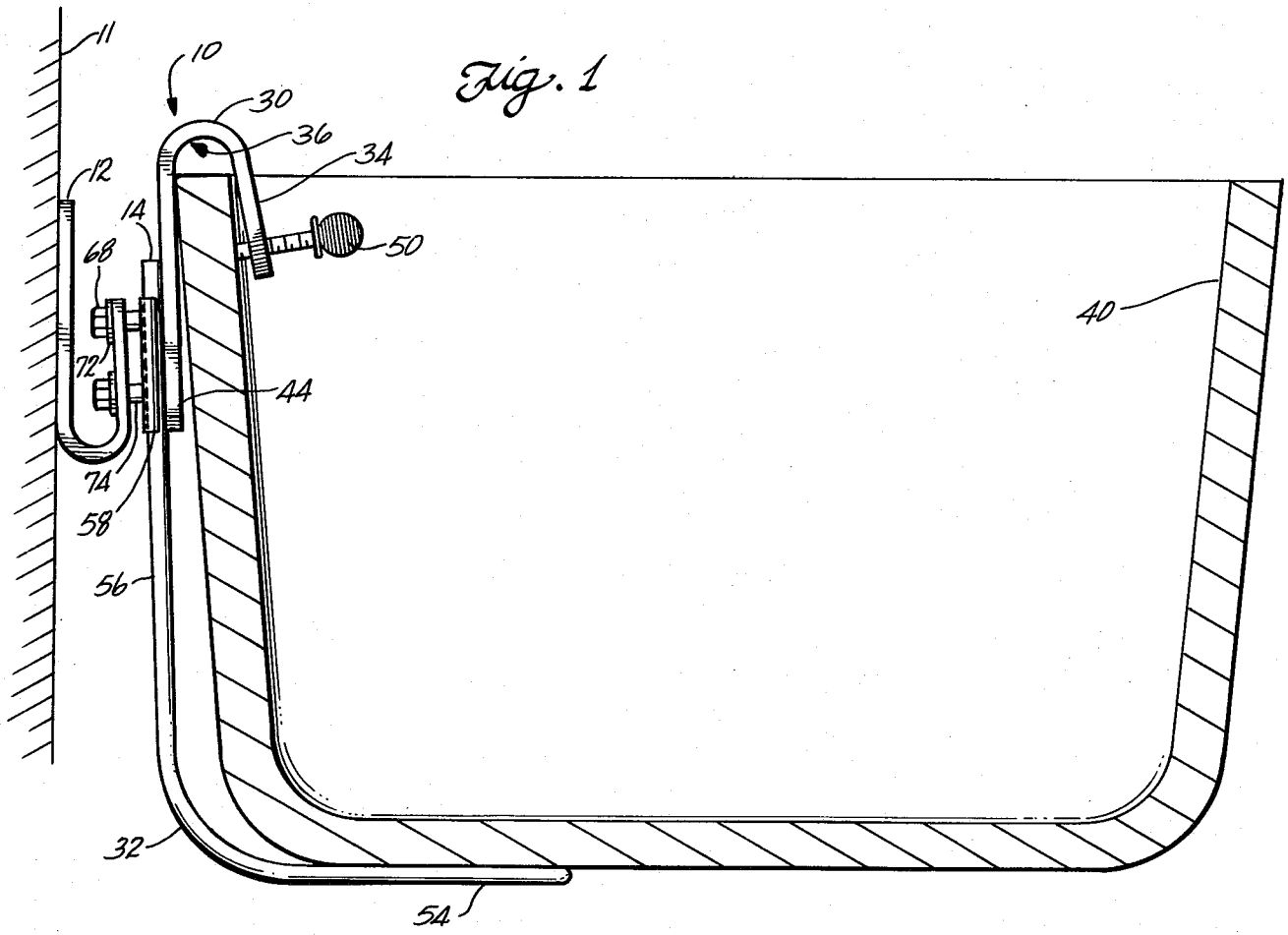
FIG. 1 is a view, partly in side elevation and partly in vertical sectional, of the detachable, adjustable plant container support device showing in particular the clamping relationship of the device with a plant container.

Referring to FIG. 1, a detachable, adjustable plant container support device 10 is shown for supporting a container in a spaced relationship to a vertical surface 11, such a wall, a post, a tree or the like. The device 10 is comprised of a wall bracket 12 and a plant container holder 14. The holder 14 is detachably attached to wall bracket 12 which is secured or affixed to vertical surface 11. Holder 14 holds and supports a container 40 which may contain a planting medium and plants (not shown).

Figures 2, 3, 4:
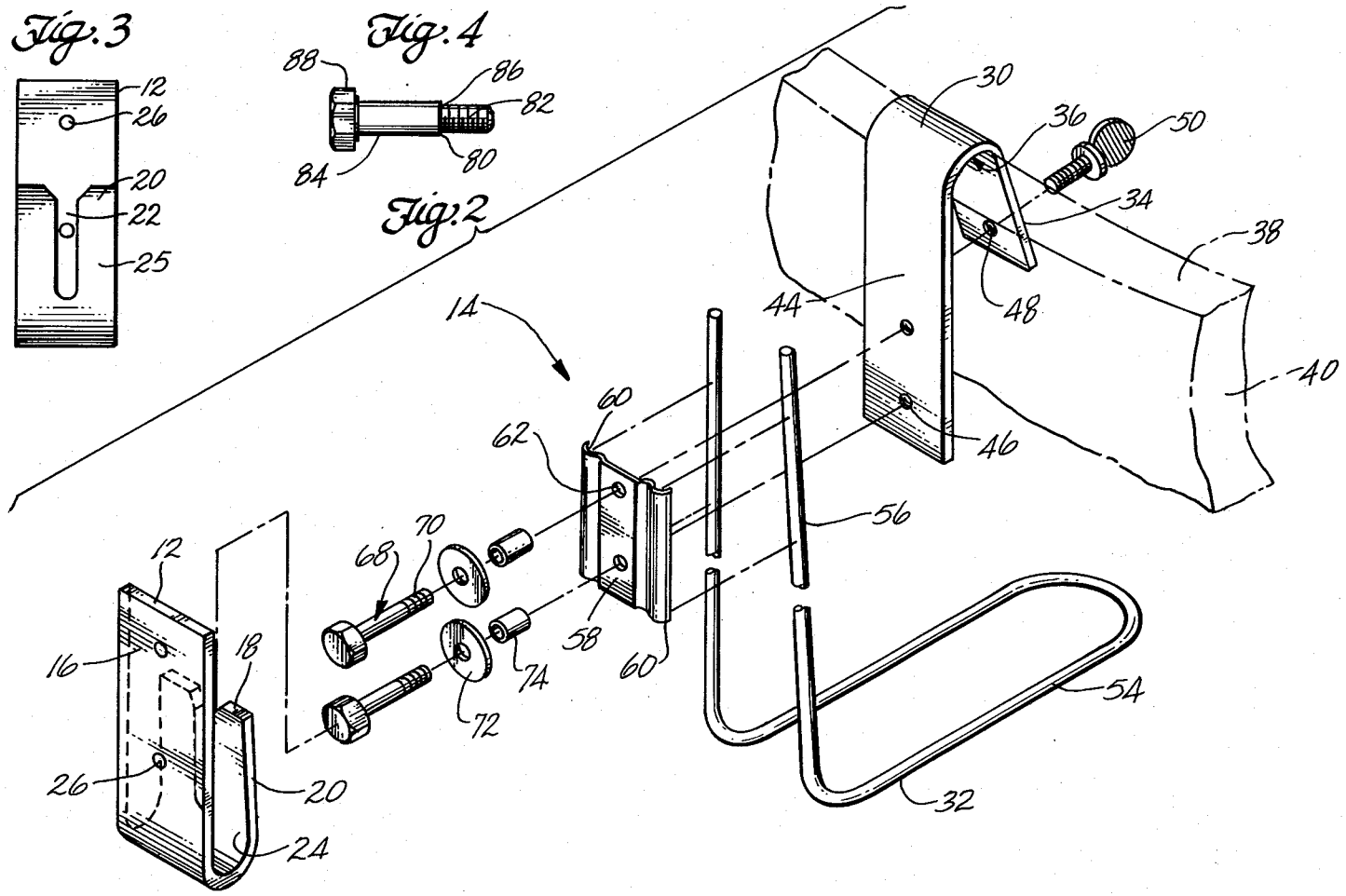
FIG. 2 is an exploded perspective view of the detachable, adjustable plant container support device embodying the invention.
FIG. 3 is a front elevational view of the wall bracket of the holder.
FIG. 4 is a side view of a shoulder bolt that may optionally be employed in the present invention.

Now referring to FIG. 2, the wall bracket 12 comprises a U-shaped longitudinal member having two upwardly extending parallel arms 16 and 18 in a spaced apart relationship. The first arm 16 is adapted to be secured to a vertical surface. The second arm has two upwardly extending parallel tines 20 at its upper end separated by a slot 22 (see FIG. 3). The tines 20 have an inner surface 24 which faces the first arm 16 and an outer surface 25 opposite the inner surface 24. The slot 22 and inner surface 24 are adapted to receive and detachably engage a hanger means of the plant container holder 14 as described below. The ball bracket 12 has two apertures 26 positioned along the vertical midline of the first arm 16 adapted for screws, nails or other fasteners for fastening the bracket 12 to a vertical surface (not shown).

The plant container holder 14 comprises a clamping member 30, a base member 32 and a hanger-retainer assembly described below. The clamping member 30 comprises an upright longitudinal strip downturned at its upper end 34 to form a hook with a downwardly presented throat 36 to receive from below an edge portion 38 of a open top container 40 and a lower end 44 having two threaded bores 46 positioned in the vertical midline axis of clamping member 30. The downturned upper end of the metal strip has a bored aperture 48 for receiving a threaded thumbscrew 50 to secure the upper portion 38 of the container 40 to the clamping member 30.

Base member 32 comprises a U-shaped element having two parallel arms and formed into a general L-shaped structure with a horizontal U-shaped base portion 54 and a pair of vertically extending parallel arms 56. The clamping member 30 and base member 32 are secured together in an adjustable relationship by retaining plate 58 and the hanger means described below.

The retaining plate 58 has two apertures 62 along its midline vertical axis which are concentric with the threaded apertures 46 of clamping member 30. Extending along the vertical sides of retainer plate 58 are longitudinal half-round channels 60 running the length of plate 58. The channels are adapted to receive the two vertically-extending parallel arms 56 of base member 32. The plate is secured to clamping member 30 by the following described hanger means.

The hanger means comprises two bolts 68, two washers 72 and two sleeve washers 74. The bolts 68 have a threaded end portion 70. The threaded end portions 70 and shank of bolt 68 are adapted to pass through aperture 62. The threaded end portion 70 is adapted to threadedly engage apertures 46 in the clamping member 30. Each bolt 68 is fitted with a washer 72 and a sleeve washer 74. When the plant container holder 14 is assembled, the upper parallel arms 56 of base member 32 rest in the slots formed by the lower end 44 of clamping member 30 and the channels 60 of retaining plate 58. The bolts 68 are tightened into apertures 46 of clamping member 30 to exert pressure against retaining plate 58 to secure the clamping member and base member. The pressure is exerted from the head of the bolts 68 through washer 72 and sleeve washer 74 to the plate 58 (see FIG. 1) When the bolts 68 are loosened, base member 32 may be slid up or down in the slots formed by plate 58 and clamping member 30 to remove a container from holder 14, or place a container 40 in holder 14. The sleeve washers 74 have a smaller external diameter than the width of slot 22 of wall bracket 12 and are adapted to be received in slot 22. The washers 72 are adapted to engage the inner surface 24 of the tines 20 and retaining plate 58 is adapted to engage the outer surface 25 of the tines 20 to detachably support the holder 14 in the wall bracket 12.

Thus, the device of this invention permits a container and its plant to be vertically mounted on a vertical surface in a secure manner preventing rotation or pitch of the container 40. The container 40 can be easily removed from its wall position by lifting the container and attached plant container holder 14 up from and away from the wall bracket 12.

The slot 22, and the bolts 68 and sleeve washers thereon prevent the container 40 and a holder 14 from rolling side to side. The washers 72 and retaining plate 58 bracker tines 20 to prevent the container 40 and holder 14 from pitching forward or backward.

Thus, the device of this invention contains and supports a container and its contents in a vertical position to permit uniform watering and nutrition of a plant in the container which in turn insures uniform plant and root growth. The device 10 of the present invention is relatively small compared to the size of the plant container 40 and thus the bulk of the device 10 is hidden from view and does not distract from the beauty of the container and plant. The device is adjustable and can readily be adapted to support containers of various heights.

In another embodiment of the invention a second flat washer (not shown) is placed on each bolt 68 between sleeve washer 74 and retaining plate 58 so that the second flat washers, rather than retaining plate 58, engage the outer face 25 of the tines 20.

In another embodiment of the invention the bolts 68, washers 72 and sleeve washers 74 are replaced by shoulder bolts 80 (see FIG. 4) which have a threaded end portion 82 separated from an an enlarged shank portion 84 by a shoulder 86 and a head 88 having an inner shoulder 90. The threaded end portion threadingly engages threaded apertures 46 of clamping member 30 and is adapted to pass through aperture 62 of plate 58. The shoulder 86 engages retaining plate 58 about the aperture 62 to bias plate 58 toward clamping member 30 to secure clamping member 30 to base member 32. The shank portion 84 is adapted to be received by the slot 22 and the shoulder 90 of head 88 is adapted to engage the inner surface 24 of tines 20 and the outer surface of plate 58 is adapted to engage the outer surface 25 of tines 20 to detachably support holder 14 on bracket 12. The function of a shoulder bolt 80 is equivalent to the function of bolt 68, washer 72 and sleeve washer 74 of the present invention. However, shoulder bolts are quite expensive and the same result can be achieved with the washer and bolt assembly illustrated in the drawings with far greater economy.

A preferred embodiment of the inventive device has been illustrated herein; however, many modifications may be made to the device without departing from the spirit of the invention. The invention is not to be limited to the precise details of construction set forth.

What is claimed is:

1. A detachable, adjustable plant container support device, for supporting a plant and its container in a spaced relationship to a vertical surface, said device comprising a wall bracket and container holder, said wall bracket comprising a U-shaped longitudinal member having first and second upwardly extending parallel arms in a spaced apart relationship, the first arm adapted to be secured to a vertical surface and the second arm having two upwardly extending parallel tines separated by an open slot adapted to detachably receive a hanger means, said tines having an inner side facing said first arm and an opposite outer side, said container support comprising a clamping member, a base member and retaining means for securing the base member to the clamping member, said clamping member adapted to hook over the top edge of an open top container having a base to secure said container from pitching and rolling with respect to said base member, said base member adapted to receive and support the base of the container, said retaining means for retaining said clamping member and base member attached to said hanger means for detachably securing said container support to said wall bracket.

2. The detachable, adjustable plant container support device according to claim, wherein said clamping member and said base member in combination with said retaining means are adapted to be vertically moved towards or away from each other to support containers of different heights.

3. The detachable, adjustable plant container support device according to claim, wherein said hanging means comprises a lug attached to said container holder and having a shank portion and an enlarged head at one end, said enlarged head adapted to be secured by said tines and said shank portion adapted to be slidably received by said slot to detachably support said container support, said lug detachably secured to said container support.

4. The detachable, adjustable container support device according to claim 1 wherein said hanging means comprises two lugs attached to said container holder, one lug positioned above the other lug, each lug having a shank portion adapted to be received by said slot and an enlarged head portion at one end adapted to slidably engage said tines to support said container support on said wall bracket, each of said lugs detachably secured to said container support.

5. The detachable, adjustable container support devices according to claim 1, wherein said clamping member comprises an upright longitudinal element downturned at its upper end to form a hook with a downwardly presented throat to receive from below an edge portion of an open top container, the lower end of said element having two threaded apertures along the vertical midline axis of said clamping member, said base member having a general L-shape with a horizontal U-shaped base portion and a vertical portion of two extended parallel arms, said retaining means comprising a retaining plate having two apertures along its vertical midline axis concentric with the threaded apertures of said clamping member, each vertical side of said plate having a longitudinal half-round channel adapted to receive said parallel arms of said base member, said parallel arms slidably secured in a channel housing formed by said clamping member and said half-round channels of said retaining plate, said hanging means comprising two lugs, each lug having a threaded end portion, a middle portion and an enlarged head at the other end, the threaded end portion separated from the middle portion by a first circumferentially extending shoulder and the head portion separated from the middle portion by a second circumferentially extending shoulder, the threaded end portion of the lugs passing through respective apertures of said plate and threadingly engaging respective threaded apertures of said clamping member, the first shoulder of the lugs engaging said plate and biasing it towards said clamping member to secure said clamping member and base member, said middle portion adapted to be slidably received in said slot with said head portion slidably engaging the inner side of said tines and said retaining plate slidably engaging the outer side surface of said tines.

6. The detachable, adjustable plant container support device according to claim 1 wherein said clamping member comprises an upright, longitudinal element downturned at its upper end to form a hook with a downwardly presented throat to receive from below an edge portion of an open top container, the lower end of said element having two threaded apertures along the vertical midline axis of said clamping member, said base member said base member having a general L-shape with a horizontal U-shaped base portion and a vertical portion of two upwardly extending parallel arms, said retaining means comprising a plate having two apertures along its vertical midline axis concentric with the threaded apertures of said upper bracket, each vertical side of said plate having longitudinal half-round channel adapted to receive said vertically extending parallel arms of said base member, said parallel arms slidably secured in a channel housing formed by said clamping member and said half-round channels of said plate, said hanger means comprising two bolts having a threaded portion, a shank portion and an enlarged head portion at the other end, and two sleeve washers adapted to be received by said shank portion of said bolts, the threaded end portions of the bolts passing through respective sleeve washers, respective apertures of said plate and threadingly engaging respective threaded apertures of said longitudinal element, one end of each of said sleeve washers engaging said head of a bolt and the other end of each sleeve washer engaging the plate about an aperture, said plate biased towards said clamping member to secure said clamping member and said base member, said sleeve washers adapted to be slidably received in said slot of said wall bracket with the head portions of said bolts slidably engaging the inner side of said tines and said plate slidably engaging the outer side of said tines.

7. A detachable, adjustable plant container support device for supporting a plant and its container in a spaced relationship to a vertical surface, said device comprising a wall bracket and container holder, said wall bracket comprising a U-shaped longitudinal member having a first and second upwardly extending parallel arms in a spaced-apart relationship, the first arm adapted to be secured to a vertical surface and the second arm having two upwardly extending parallel tines separated by an open slot, said tines having an inner side facing said first arm and an opposing outer side, said container support comprising a clamping member, a base member and retaining means for securing the base member to the clamping member and for detachably securing the container holder to said wall bracket, said clamping member comprising an upright longitudinal element downturned at its upper end to form a hook with a downwardly presented throat to receive from below an edge portion of an open top container, the lower end of said element having two threaded apertures along the vertical midline axis of said clamping member, said base member having a general L-shape with a horizontal U-shaped base portion and a vertical portion of two extended parallel arms, said retaining means comprising a retaining plate and two bolt assemblies, said retaining plate having two apertures along its vertical midline axis concentric with the threaded apetures of said clamping member, each vertical side of said plate having a longitudinal half-round channel adapted to receive said parallel arms of said base member, said parallel arms slidably secured in a channel housing formed by said clamping member and said half-round channels of said retaining plate, said bolt assemblies comprising two bolts, two flat washers and two sleeve washers, each bolt having a threaded end portion and an opposing end enlarged head portion, the flat washers and sleeve washers adapted to be received by said bolts, the threaded end portion of said bolts passing through respective flat washers, sleeve washers and apetures in said retaining plate and threadingly engaging respective threaded apertures in said clamping member, said retaining plate biased towards said clamping member to slidably secure said clamping member and said base member, said sleeve washers adapted to be slidably received in said open slot of said wall bracket with the flat washers adapted to slidably engage the inner surface of said tines of said wall bracket and the retaining plate adapted to slidably engage the outer surface of said tines.

* * * * *